US006010576A

United States Patent [19]

Lin

[11] Patent Number: 6,010,576

[45] Date of Patent: Jan. 4, 2000

[54] APPARATUS AND METHOD FOR CLEANING AN EXHAUST GAS REACTOR

[75] Inventor: Yung-Pin Lin, Taichung, Taiwan

[73] Assignee: Taiwan Semiconductor Manufacturing Company, Ltd., Hsin-Chu, Taiwan

[21] Appl. No.: 09/141,065

[22] Filed: Aug. 27, 1998

[51] Int. Cl.[7] ..... B08B 9/04

[52] U.S. Cl. ..... 134/8; 134/22.11; 15/246.5; 15/104.095; 15/104.096; 55/295

[58] Field of Search ..... 15/104.09, 104.096, 15/104.11, 236.05, 236.1, 246.5, 249.1, 249.2, 104.068, 104.05, 104.095; 134/8, 6, 22.11; 55/295; 422/210

[56] References Cited

U.S. PATENT DOCUMENTS 3,199,575 8/1965 Keller ..... 15/246.5

4,372,761 2/1983 Lindroos ..... 422/210

5,832,843 11/1998 Park et al. ..... 110/214

*Primary Examiner*—Robert J. Warden, Sr.

*Assistant Examiner*—Kaj K. Olsen

*Attorney, Agent, or Firm*—Tung & Associates

[57] ABSTRACT

An apparatus and a method for cleaning a conduit that has unwanted chemical substances deposited on an interior wall of the conduit are provided. The apparatus utilizes a rack-and-pinion drive mechanism for moving a set of cleaning blades in a rotational motion such that the blades may be driven more reliably and more accurately. The rack-and-pinion drive mechanism further allows the set of cleaning blades to scrape off chemical substances in two directions, i.e., when the pinion gear is rotated either clockwise or counterclockwise. The present invention novel apparatus further provides the alternative of having a second set of blades mounted below the main set of cleaning blades such that a second conduit section situated below the conduit may also be cleaned.

20 Claims, 4 Drawing Sheets

APPARATUS AND METHOD FOR CLEANING AN EXHAUST GAS REACTOR

FIELD OF THE INVENTION

The present invention generally relates to an apparatus and a method for cleaning a conduit that has unwanted chemical substances deposited on an interior wall and more particularly, relates to an apparatus and a method for cleaning an exhaust gas reactor that has unwanted chemical substances coated on its interior wall by utilizing a plurality of cleaning knife blades mounted on a pinion gear driven by a rack such that the interior wall of the reactor may be scraped for removing the unwanted chemical substances.

BACKGROUND OF THE INVENTION

In the chemical industry, many processes conducted in a plant include the step of treating effluent or exhaust gases from a process machine. The treatment is necessary to either complete a chemical reaction such that unreacted chemicals are not released into the atmosphere, or to convert toxic or flammable components of an exhaust gas into non-toxic or non-flammable components before they are released into the atmosphere. The treatment of effluent gases is particularly important in a semiconductor fabrication plant since most of the process gases utilized are either highly toxic or highly flammable.

A controlled decomposition/oxidation (or CDO) system 10 that is equipped with recirculation and sump pumps is shown as an example in FIG. 1. One of such CDO system is marketed by the Delatech Corp. of Napa, Calif. as part of an exhaust gas conditioning equipment. The system 10 is effective in treating or scrubbing exhaust gases through a thermal reaction section 12 and a cooling/scrubbing section 14. Exhaust gases 18 from a semiconductor process chamber enter into the system through inlet 20 and are first treated in an oxygenation reaction section 22. The oxygenated exhaust gases then enter the thermal reaction section 12 which is heated by heating elements 24. Heating elements 24 are powered by an electric wiring fed through a wiring connector (not shown) and controlled by thermocouple 28.

The thermally reacted exhaust gases then enter into a primary cooling/scrubbing section 30 which is equipped with a conduit cleaning apparatus 34 and a cleaning water supply line 36. Cooling water (not shown) is sprayed through a plurality of nozzles 38 to cool off the high temperature thermally reacted exhaust gases. The temperature of the thermally reacted exhaust gases can reach above 800° C. and therefore must be cooled before it is processed by the secondary cooling/scrubbing section 14. The cleaning apparatus 34 is constructed of a gear 42 that has two cleaning blades 46 installed thereon for scrapping an interior wall 26 to remove unwanted chemical substances deposited thereon. A detailed description of the cleaning apparatus 34 will be given in a later section in reference to FIG. 2.

The function of the cleaning apparatus 34 is to remove the chemical substances (not shown) that have been cumulated and deposited on the interior wall 26 of the exhaust conduit 54 in the thermal reaction section 12. These chemical substances include a variety of high temperature films, nitride powders and films, etc., which normally form a hard and highly resilient substance that is difficult to remove.

Cooled exhaust gases enter into the secondary cooling/scrubbing section 14 and are treated by the scrub packing 48 before it is released to the atmosphere through an outlet 52. The apparatus 10 is effective for treating exhaust gases from a semiconductor fabrication machine that contains toxic elements by first treating in a high temperature oxygenation reaction, converting to a lower temperature, and then converting toxic substances into non-toxic substances such that they can be safely released into the atmosphere.

In the exhaust gas reactor shown in FIG. 1, it has been found that while the apparatus generally achieves the desirable results of toxic gas conversions, a deposition of hard chemical substances on the interior wall 26 in the thermal reaction section 12 can not be avoided. A conventional conduit cleaning apparatus 34 which is equipped with scrapping blades 46 and water spray nozzles 38 is not effective in cleaning the exhaust conduit 54. A detailed perspective view of the components in the cleaning apparatus 34 is shown in FIG. 2.

FIG. 2 is a perspective view of the components of the cleaning apparatus 34. The components include an upper support bracket 56, a pair of cleaning blades 58, a flange plate 60, a Teflon bearing 62, a gear wheel 64, a flange housing 66, a solenoid operated drive 68 which has a pushrod 70 installed thereon, a lower Teflon bearing 62 and a lower flange plate 72. The key mechanism of the cleaning apparatus 34 is the cleaning blades 58, the gear wheel 64 and the solenoid driven cylinder 68 together with the pushrod 70. In operation, unidirectional gear teeth 74 located on the face of the gear wheel 64 are pushed by the pushrod 70 each time the solenoid driven cylinder 68 is activated. The cleaning blades 58 are each equipped with a single knife edge (not shown) such that they perform an unidirectional cleaning operation of the interior wall 26 (FIG. 1) of the thermal reaction section 12. Each time the tip 76 of the pushrod 70 advances the gear wheel 64 by 1/16 of the circumference of the interior wall 26. In general, it takes about 160 seconds for the cleaning blades to make a complete sweep of the circumferential surface of the interior wall 26.

Numerous problems have been observed in utilizing the conduit cleaning apparatus 34 during an exhaust gas treatment process. For instance, the displacement of the cleaning blades 58 is limited such that they do not clean the interior wall efficiently. Secondly, since there are only two blades and only one knife edge available for unidirectional cleaning, the cleaning efficiency of the two blades is limited. Thirdly, the high load on the cleaning blades frequently causes the blade to deform and thus stops its cleaning function. Fourthly, the mounting screws of the cleaning blades to the gear wheel 64 frequently break or otherwise deform to disable the blades. Various other problems may also be caused by a disfunctioning of the pushrod mounted on the solenoid driven cylinder 68. For instance, the tip 76 of the pushrod may break or deform such that the gear teeth 74 on the gear wheel 64 are not touched and as a result, the advancement of the cleaning blades 58 completely stops. Furthermore, the pushrod 70 frequently jam between the flange housing and the gear wheel 64 to cause the cleaning apparatus to stop functioning.

It is therefore an object of the present invention to provide an apparatus for cleaning a conduit that has unwanted chemical substances coated on an interior wall that does not have the drawbacks and shortcomings of a conventional cleaning apparatus.

It is another object of the present invention to provide an apparatus for cleaning a conduit that has unwanted chemical substances deposited on an interior wall by utilizing a rack-and-pinion drive mechanism for driving at least two cleaning blades.

It is a further object of the present invention to provide an apparatus for cleaning a conduit that has unwanted chemical substances deposited on an interior wall by utilizing cleaning blades that are equipped with two oppositely facing knife blades such that the blades may clean in both a clockwise and a counterclockwise directions.

It is another further object of the present invention to provide an apparatus for cleaning a cavity in an exhaust gas reactor by utilizing a pinion gear equipped with at least two cleaning blades installed thereon and driven by a rack such that a linear motion of the rack is transformed into a rotational motion of the pinion gear allowing the cleaning blades to scrape the interior wall of the cavity.

It is still another object of the present invention to provide an apparatus for cleaning a cavity in an exhaust gas reactor by utilizing three upper cleaning blades and three lower cleaning blades mounted to a pinion gear such that not only the cavity in the exhaust gas reactor but also a chamber below such cavity of the reactor can be cleaned.

It is yet another object of the present invention to provide an apparatus for cleaning a cavity in an exhaust gas reactor wherein at least two cleaning blades are mounted on a pinion gear such that knife edges on the cleaning blades are situated in a circumference that is not more than 10 mm smaller than a circumference of an interior wall of the cavity.

It Is still another further object of the present invention to provide a method for cleaning a conduit that has unwanted chemical substances coated on an interior wall of the conduit by utilizing a cleaning apparatus that comprises a pinion gear and at least two cleaning blades installed thereon for scrapping the interior wall of the conduit.

It is yet another further object of the present invention to provide a method for cleaning a conduit that has unwanted chemical substances coated on an interior wall of the conduit by first providing a cleaning apparatus that includes a pinion gear with at least two cleaning blades mounted thereon each having two oppositely facing knife blades such that the cleaning blades cleans in both directions when the pinion gear turns in a clockwise or in a counterclockwise direction.

SUMMARY OF THE INVENTION

In accordance with the present invention, an apparatus for cleaning a conduit that has unwanted chemical substances coated on an interior wall and a method for utilizing such apparatus are provided.

In a preferred embodiment, an apparatus for cleaning a conduit that has unwanted chemical substances deposited on an inner wall is provided which includes a pinion gear that has at least two spokes radiating inwardly from an inner rim of the pinion gear toward a center adapted for mounting thereto the lower ends of at least two blades equally spaced from each other circumferentially, an upper retaining bracket of circular shape adapted for mounting thereto the upper ends of the at least two blades equally spaced from each other circumferentially, the at least two blades when mounted in the pinion gear and the upper retaining bracket each has two oppositely facing knife edges such that at least four knife edges are situated in a circumference that is not more than 10 mm smaller than the circumference of an inner wall of the conduit to be cleaned, and a rack for intimately engaging the pinion gear adapted for transforming a linear motion of the rack to a rotational motion of the pinion gear in both clockwise and counterclockwise directions to enable the at least four knife edges to scrape off unwanted chemical substances from the inner wall of the conduit.

The apparatus may further include at least two lower blades that has upper ends mounted to the at least two spokes in the pinion gear and lower ends mounted to a lower retaining bracket, the at least two lower blades are situated equally spaced from each other circumferentially and are adapted for cleaning a second conduit situated below the conduit. The at least two spokes may be three spokes, and the at least two blades may be three blades while the at least four knife edges may be six knife edges. The apparatus may further include a circular-shaped housing for mounting the pinion gear and the rack therein for achieving an intimate engagement. The apparatus may further include an electrically operated drive means for reciprocally driving the rack in linear motion. The apparatus may further include means for manually driving the rack. The apparatus may be adapted for cleaning the interior wall of a thermal reactor in an exhaust gas conditioning equipment.

In another preferred embodiment, an apparatus for cleaning a cavity in an exhaust gas reactor is provided which includes a pinion gear that has three spokes extending inwardly from an inner rim of the pinion gear toward the center adapted for mounting the lower ends of three blades equally spaced from each other circumferentially, an upper retaining bracket of circular shape adapted for mounting thereto upper ends of the three blades equally spaced from each other circumferentially, the three blades when mounted in the pinion gear and the upper retaining bracket each has two oppositely facing knife edges such that six knife edges are situated in a circumference that is not more than 10 mm smaller than a circumference of an inner wall of the cavity to be cleaned, and a rack for engaging the pinion gear adapted for transforming a linear motion of the rack to a rotational motion of the pinion gear in both clockwise and counterclockwise directions to enable the six knife edges to scrape off unwanted chemical substances from the inner wall of the cavity.

The six knife edges are situated in a circumference that is preferably not more than 5 mm smaller than the circumference of an inner wall of the cavity to be cleaned. The apparatus may further include three lower blades that have upper ends mounted to the three spokes in the pinion gear and lower ends mounted to a lower retaining bracket. The three lower blades may be situated equally spaced from each other circumferentially and are adapted for cleaning a second cavity situated below the cavity. The apparatus may further include a circular-shaped housing for mounting the pinion gear and the rack therein for achieving an intimate engagement between the pinion gear and the rack. The apparatus may further include an electrical drive means for reciprocally driving the rack in linear motion. The exhaust gas reactor can be a thermal reactor utilized in an exhaust gas conditioning equipment. The apparatus may further include means for manually driving the rack.

The present invention is further directed to a method for cleaning a conduit that has unwanted chemical substances coated on an inner wall by the operating steps of first providing a cleaning apparatus that has a pinion gear having at least two blades mounted thereon at a lower end, the lower ends of the at least two blades are mounted to an upper retaining bracket, the at least two blades each has two oppositely facing knife edges for frictionally engaging the unwanted chemical substances coated on the inner wall of the conduit, and a rack for intimately engaging the pinion gear, then positioning the at least two blades into the conduit, and reciprocally moving the rack and transforming a linear motion of the rack to a rotational motion of the pinion gear in both clockwise and counterclockwise directions to enable the at least four knife edges to scrape off unwanted chemical substances from the inner wall of the conduit.

The method may further include the step of providing at least two lower blades each has an upper end mounted to the pinion gear and lower end to a lower retaining bracket, and rotating the at least two lower blades for cleaning the interior wall of a second conduit situated below the conduit. The at least two blades may be three blades and the at least four knife edges may be six knife edges. The method may further include the step of providing a circular-shaped housing and mounting the pinion gear and the rack therein to achieve an intimate engagement. The method may further include the step of providing an electrical drive means for reciprocally driving the rack in linear motion. The method may still further be adapted for cleaning the interior wall of a thermal reactor in an exhaust gas conditioning equipment.

BRIEF DESCRIPTION OF THE DRAWINGS

These and other objects, features and advantages of the present invention will become apparent from the following detailed description and the appended drawings in which.

Detailed Description of the Preferred Embodiment

In accordance with the present invention, an apparatus and a method for cleaning a conduit that has unwanted chemical substances coated on an inner wall are provided. The cleaning apparatus is operated by a principle of rack-and-pinion drive of a set of cleaning blades that are mounted on a pinion gear for driven by a rack. A solenoid type drive cylinder is used to provide a linear motion of a rack which is transformed to a rotational motion of a pinion gear when the rack intimately engages the pinion gear. A cleaning blade system of at least two blades, and preferably at least three blades are utilized in the present invention novel apparatus. The cleaning blades are each equipped with two oppositely facing knife edges such that the blades are capable of cleaning when the pinion gear is turned either in a clockwise direction or in a counterclockwise direction. The advantages provided by the double-faced cleaning blades and the precision drive of a rack-and-pinion system provides a cleaning method that is far superior than those achievable by conventional cleaning apparatus. The chances of malfunction of the apparatus are greatly reduced which result in a great improvement in the cleaning efficiency and a resultant improvement in the wafer fabrication yield. The present invention apparatus and method therefore provide a greatly improved result in cleaning a conduit or a cavity that has unwanted chemical substances deposited therein than those achieved by the conventional methods.

Figure 1:
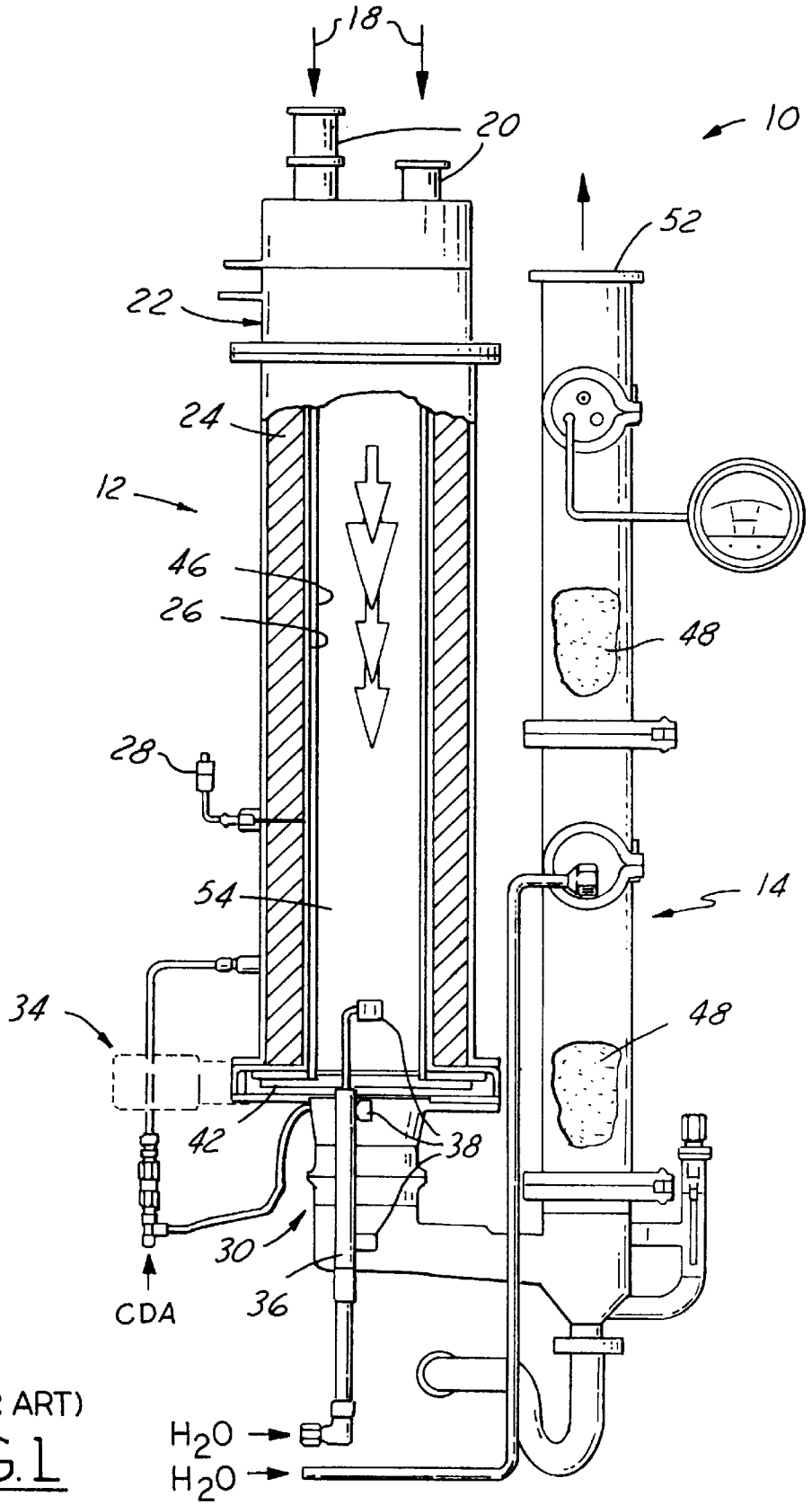
(PRIOR ART) FIG. 1
FIG. 1 is a cross-sectional view of a conventional exhaust gas treatment system including a thermal reaction section.
Figure 2:
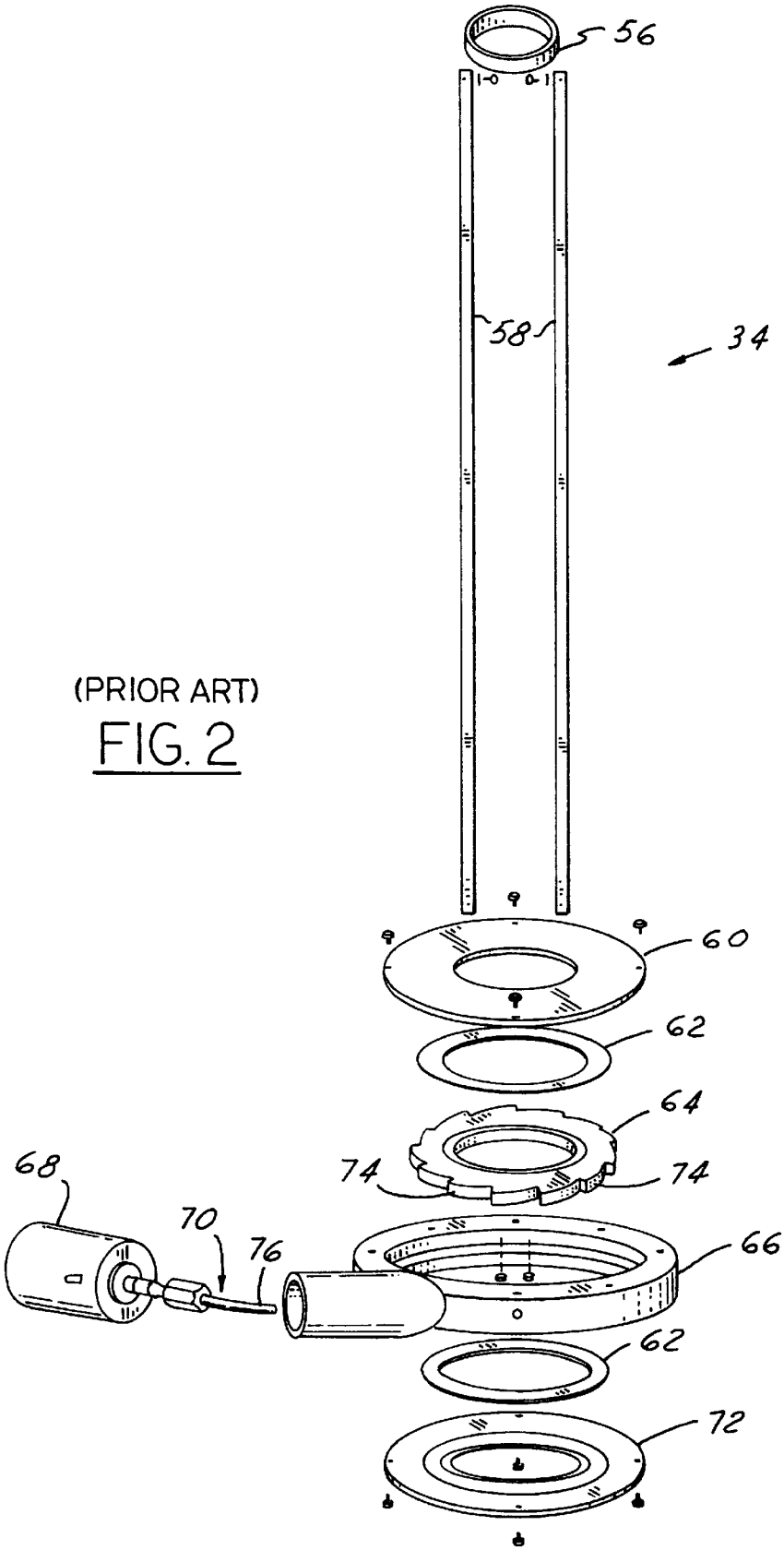
(PRIOR ART) FIG. 2
FIG. 2 is an enlarged, perspective view of the components of the conventional cleaning apparatus utilized in the thermal reaction section shown in FIG. 1.
Figure 3:
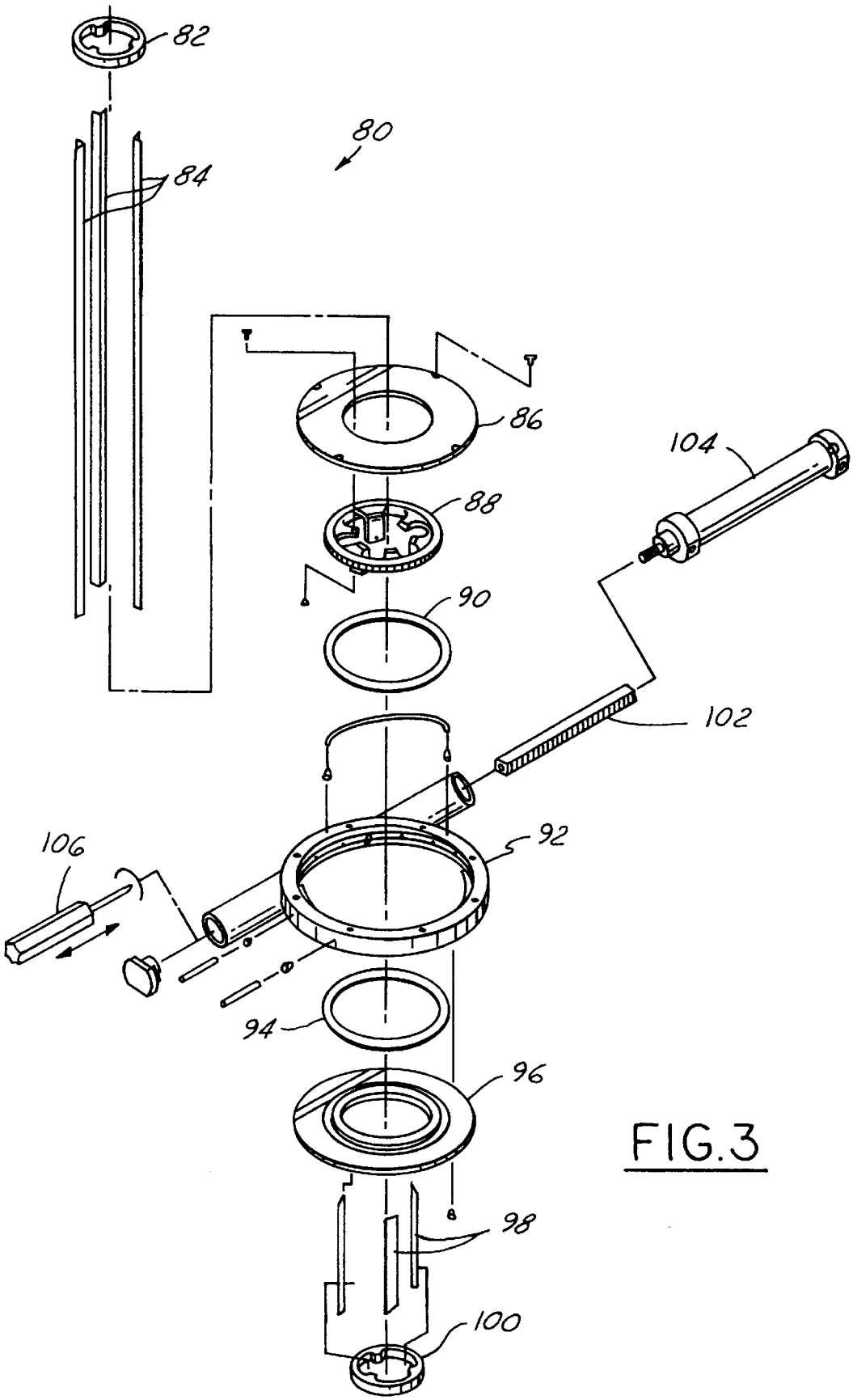
FIG. 3 is a perspective view of the present invention conduit cleaning apparatus utilizing a rack-and-pinion driven cleaning blade system.
Figure 4:
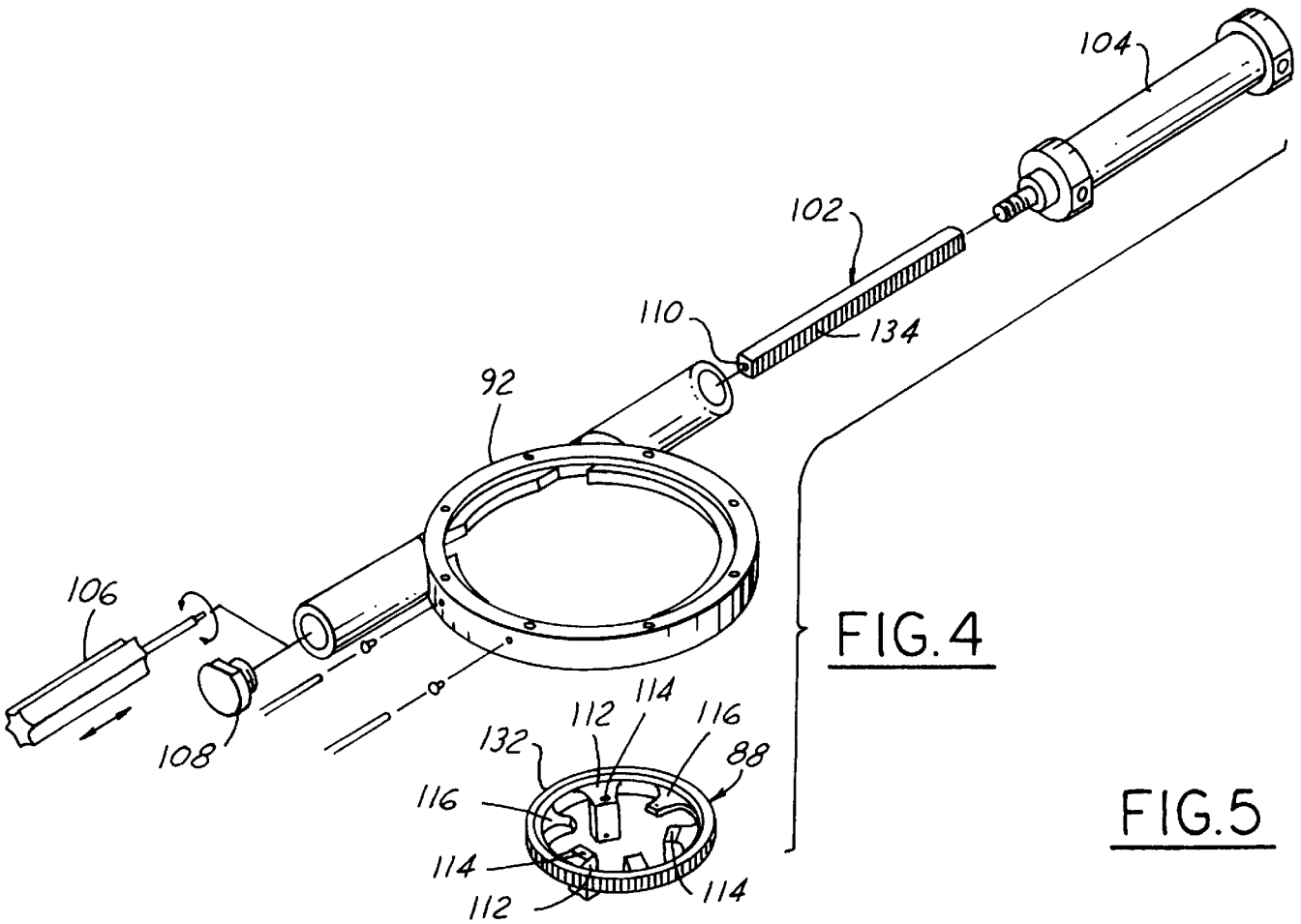
FIG. 4 is an enlarged, cross-sectional view of the rack-and-pinion arrangement used in the present invention cleaning apparatus of FIG. 3.

Referring now to FIG. 3, wherein a present invention cleaning apparatus 80 is shown. The cleaning apparatus 80 consists mainly of an upper retaining bracket 82, a set of cleaning blades 84, an upper flange plate 86, a pinion gear 88, an upper Teflon bearing 90, a flange housing 92, a lower Teflon bearing 94, a lower flange plate 96, a set of lower cleaning blades 98 and a lower retaining bracket 100. Assembled into the flange housing 92 are a rack 102, an electrical solenoid-type drive cylinder 104 and a manually operated handle 106. A perspective view of the drive mechanism for the present invention novel cleaning apparatus 80 is shown in FIG. 4. For instance, shown in enlarged views are the flange housing 92, the end cap 108, the pinion gear 88, the rack 102 and the solenoid-type drive cylinder 104. A manually operated handle 106 for the rack 102 is also shown. When attached to a threaded aperture 110 at the tip of the rack 102, the handle 106 may be used to manually displace the rack in a linear motion, for instance, during a preventive maintenance procedure. As shown in FIG. 4, the pinion gear 88 is equipped with three spokes 112 each having an aperture 114 for mounting the set of cleaning blades 84 therein. Tabs 116 are also provided for mounting the pinion gear 88 to the flange housing 92.

Figure 5:
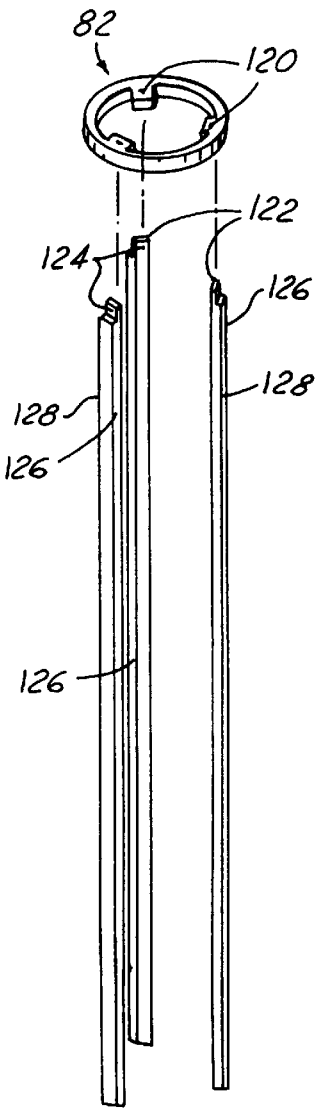
FIG. 5 is an enlarged, perspective view of the cleaning blades utilized in the present invention cleaning apparatus of FIG. 3.

Enlarged, perspective views of the cleaning blades 84 and the upper retaining bracket 82 are shown in FIG. 5. It is seen that the upper retaining bracket 82 is equipped with bosses 120 for mounting thereto the upper tip 122 of the blades 84. Mounting holes 124 are provided in the tip 122 for mounting the blades by screws to the upper retaining bracket 82. It should be noted that each of the cleaning blades 84, is provided with two oppositely facing knife blades 126 and 128 such that the blades 84 may cut into the unwanted chemical substances when the blades are turned either in a clockwise direction or in a counterclockwise direction. This is one of the benefits made possible by the present invention novel apparatus.

Another benefit provided by the present invention novel apparatus is the rack-and pinion drive mechanism shown in FIG. 4. The rack 102 and the pinion gear 88 are intimately matched together such that several teeth 132 on the pinion gear 88 engage a small section of the teeth 134 on the rack 102 simultaneously. This is a significantly improved drive mechanism than that provided in the conventional apparatus wherein only one tooth is engaged by a pushrod at a time. A more reliable drive is therefore provided by the present invention apparatus. Furthermore, instead of pushing a gear wheel only in one direction in the conventional drive mechanism, the reciprocal movement of the present invention rack 102 results in a rotational motion of the pinion gear 88 in two directions, i.e., clockwise and counterclockwise. Combined with the double-edged blades 84, the efficiency of scraping off unwanted chemical substances from the interior wall of a reactor is greatly improved when the substances are removed by the double-edged blades with the rack been pushed or pulled. The present invention rack-and-pinion drive mechanism therefore provides a greatly improved and unexpected result over that achievable by the conventional apparatus.

The present invention novel apparatus and method have therefore been amply demonstrated in the above descriptions and in the appended drawings of FIGS. 3~5. It should be noted that while the present invention apparatus is illustrated in the environment of a thermal reaction chamber for an exhaust gas conditioning equipment, the apparatus may be similarly used in any equipment for the cleaning of a conduit as long as there is unwanted chemical substances cumulated on an interior wall of the conduit.

While the present invention has been described in an illustrative manner, it should be understood that the terminology used is intended to be in a nature of words of description rather than of limitation.

Furthermore, while the present invention has been described in terms of a preferred embodiment and an alternate embodiment, it is to be appreciated that those skilled in the art will readily apply these teachings to other possible variations of the inventions.

The embodiment of the invention in which an exclusive property or privilege is claimed are defined as follows:

What is claim is:

1. An apparatus for cleaning a conduit having unwanted chemical substances deposited on an inner wall comprising:

a pinion gear having at least two spokes radiating inwardly from an inner rim of said pinion gear toward a center adapted for mounting thereto the lower ends of at least two blades equally spaced from each other circumferentially, an upper retaining bracket of circular shape adapted for mounting thereto the upper ends of said at least two blades equally spaced from each other circumferentially, said at least two blades when mounted in said pinion gear and said upper retaining bracket each blade having two oppositely facing knife edges such that at least four knife edges are situated in a circumference that is not more than 10 mm smaller than the circumference of an inner wall of said conduit to be cleaned, and a rack for intimately engaging said pinion gear adapted for transforming a linear motion of the rack to a rotational motion of the pinion gear in both clockwise and counterclockwise directions to enable said at least four knife edges to scrape off unwanted chemical substances from said inner wall of said conduit.

2. An apparatus for cleaning a conduit having unwanted chemical substances deposited on an inner wall according to claim 1 further comprising at least two lower blades having upper ends mounted to said at least two spokes in the pinion gear and lower ends mounted to a lower retaining bracket, said at least two lower blades are situated equally spaced from each other circumferentially and are adapted for cleaning a second conduit situated below said conduit.

3. An apparatus for cleaning a conduit having unwanted chemical substances deposited on an inner wall according to claim 1, wherein said at least two spokes are three spokes, said at least two blades are three blades and said at least four knife edges are six knife edges.

4. An apparatus for cleaning a conduit having unwanted chemical substances deposited on an inner wall according to claim 1 further comprising a circular-shaped housing for mounting said pinion gear and said rack therein for achieving an intimate engagement.

5. An apparatus for cleaning a conduit having unwanted chemical substances deposited on an inner wall according to claim 1 further comprising an electrically operated drive means for reciprocally driving said rack in linear motion.

6. An apparatus for cleaning a conduit having unwanted chemical substances deposited on an inner wall according to claim 1 further comprising means for manually driving said rack.

7. An apparatus for cleaning a conduit having unwanted chemical substances deposited on an inner wall according to claim 1, wherein said apparatus being adapted for cleaning the interior wall of a thermal reactor in an exhaust gas conditioning equipment.

8. An apparatus for cleaning a cavity in an exhaust gas reactor comprising:

a pinion gear having three spokes extending inwardly from an inner rim of said pinion gear toward the center adapted for mounting thereto lower ends of three blades equally spaced from each other circumferentially, an upper retaining bracket of circular shape adapted for mounting thereto upper ends of said three blades equally spaced from each other circumferentially, said three blades when mounted in said pinion gear and said upper retaining bracket each blade having two oppositely facing knife edges such that six knife edges are situated in a circumference that is not more than 10 mm smaller than the circumference of an inner wall of the cavity to be cleaned, and a rack for engaging said pinion gear adapted for transforming a linear motion of the rack to a rotational motion of the pinion gear in both clockwise and counterclockwise directions to enable said six knife edges to scrape off unwanted chemical substances from said inner wall of said cavity.

9. An apparatus for cleaning a cavity in an exhaust gas reactor according to claim 8, wherein said six knife edges are situated in a circumference that is preferably not more than 5 mm smaller than the circumference of an inner wall of said cavity to be cleaned.

10. An apparatus for cleaning a cavity in an exhaust gas reactor according to claim 8 further comprising three lower blades having upper ends mounted to said three spokes in the pinion gear and lower ends mounted to a lower retaining bracket, said three lower blades are situated equally spaced from each other circumferentially and are adapted for cleaning a second cavity situated below said cavity.

11. An apparatus for cleaning a cavity in an exhaust gas reactor according to claim 8 further comprising a circular-shaped housing for mounting said pinion gear and said rack therein for achieving an intimate engagement between the pinion gear and the rack.

12. An apparatus for cleaning a cavity in an exhaust gas reactor according to claim 8 further comprising an electrical drive means for reciprocally driving said rack in linear motion.

13. An apparatus for cleaning a cavity in an exhaust gas reactor according to claim 8, wherein said exhaust gas reactor is a thermal reactor in an exhaust gas conditioning equipment.

14. An apparatus for cleaning a cavity in an exhaust gas reactor according to claim 8 further comprising means for manually driving said rack.

15. A method for cleaning a conduit which has unwanted chemical substances coated on an inner wall comprising the steps of:

providing a cleaning apparatus comprising a pinion gear having at least two blades mounted thereon at a lower end, said upper ends of said at least two blades are mounted to an upper retaining bracket, said at least two blades each having two oppositely facing knife edges for frictionally engaging the unwanted chemical substances coated on said inner wall of the conduit, and a rack for intimately engaging said pinion gear, positioning said at least two blades into said conduit, and reciprocally moving said rack and transforming a linear motion of the rack to a rotational motion of the pinion gear in both clockwise and counterclockwise directions to enable said at least four knife edges to scrape off unwanted chemical substances from said inner wall of the conduit.

16. A method for cleaning a conduit that has unwanted chemical substances coated on an inner wall according to claim 15 further comprising the step of providing at least two lower blades having upper ends mounted to said pinion gear and lower ends to a lower retaining bracket, and rotating said at least two lower blades for cleaning the interior wall of a second conduit situated below the conduit.

17. A method for cleaning a conduit that has unwanted chemical substances coated on an inner wall according to claim 15, further comprising the step of providing where the said at least two blades are three blades and where the said at least four knife edges are six knife edges.

18. A method for cleaning a conduit that has unwanted chemical substances coated on an inner wall according to claim 15 further comprising the step of providing a circular-shaped housing and mounting said pinion gear and said rack therein to achieve an intimate engagement.

19. A method for cleaning a conduit that has unwanted chemical substances coated on an inner wall according to claim 15 further comprising the step of providing an electrical drive means for reciprocally driving said rack in linear motion.

20. A method for cleaning a conduit that has unwanted chemical substances coated on an inner wall according to claim 15 wherein said method being adapted for cleaning the interior wall of a thermal reactor in an exhaust gas conditioning equipment.

* * * * *